US009359058B1

(12) United States Patent
Langenfeld et al.

(10) Patent No.: US 9,359,058 B1
(45) Date of Patent: Jun. 7, 2016

(54) OUTBOARD MARINE PROPULSION DEVICES AND METHODS OF MAKING OUTBOARD MARINE PROPULSION DEVICES HAVING EXHAUST RUNNER COOLING PASSAGES

(71) Applicant: Brunswick Corporation, Lake Forest, IL (US)

(72) Inventors: Gregg D. Langenfeld, Fond du Lac, WI (US); David J. Hilbert, Black Creek, WI (US); Ryan E. Mueller, Ripon, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 14/794,971

(22) Filed: Jul. 9, 2015

(51) Int. Cl.

| | |
|---|---|
| ***B63H 21/32*** | (2006.01) |
| ***F01N 3/04*** | (2006.01) |
| ***B63H 20/24*** | (2006.01) |
| ***B63H 20/28*** | (2006.01) |
| ***B63H 20/00*** | (2006.01) |

(52) U.S. Cl.
CPC ..... *B63H 20/24* (2013.01); *B63H 20/00* (2013.01); *B63H 20/28* (2013.01)

(58) Field of Classification Search
CPC ..... B63H 20/00; B63H 20/001; B63H 20/24; B63H 20/28; B63H 2020/00; F01N 3/04
USPC ..... 440/89 R, 89 B, 89 C, 89 H, 89 J
See application file for complete search history.

(56) References Cited

U.S. PATENT DOCUMENTS

| | | | | |
|---|---|---|---|---|
| 1,783,714 | A * | 12/1930 | Horning | F02B 23/08 123/657 |
| 5,306,185 | A | 4/1994 | Lassanske et al. | |
| 6,039,012 | A * | 3/2000 | Motoyama | F02B 27/06 123/65 PE |
| 6,302,754 | B1 * | 10/2001 | Kashima | F01N 13/004 440/88 R |
| 6,511,355 | B1 | 1/2003 | Woodward | |
| 6,662,555 | B1 | 12/2003 | Ishii | |
| 7,704,111 | B2 | 4/2010 | Ito et al. | |
| 7,954,314 | B1 | 6/2011 | Bruestle et al. | |
| 8,038,493 | B1 | 10/2011 | Broman et al. | |
| 8,298,026 | B2 | 10/2012 | Ochiai | |
| 8,402,930 | B1 | 3/2013 | Taylor et al. | |
| 8,444,447 | B2 | 5/2013 | Ochiai | |
| 8,479,691 | B1 | 7/2013 | Taylor et al. | |
| 8,500,501 | B1 | 8/2013 | Taylor et al. | |
| 8,540,536 | B1 | 9/2013 | Eichinger et al. | |
| 8,696,394 | B1 | 4/2014 | Langenfeld et al. | |
| 8,763,566 | B1 | 7/2014 | Taylor et al. | |
| 8,783,217 | B1 | 7/2014 | Taylor et al. | |
| 2002/0034900 | A1 * | 3/2002 | Kato | B63H 20/26 440/89 H |
| 2008/0166935 | A1 | 7/2008 | Ito et al. | |
| 2009/0130928 | A1 * | 5/2009 | Taylor | F01N 3/046 440/88 M |

* cited by examiner

*Primary Examiner* — Daniel V Venne
(74) *Attorney, Agent, or Firm* — Andrus Intellectual Property Law, LLP

(57) ABSTRACT

An outboard marine propulsion device comprises an internal combustion engine. At least one engine cooling passage conveys cooling water through the internal combustion engine. An exhaust manifold comprises a plurality of exhaust runners and an exhaust log. The plurality of exhaust runners axially conveys exhaust gases from the internal combustion engine to the exhaust log. A cooling jacket on the exhaust manifold comprises an exhaust log cooling jacket that conveys the cooling water along an outer surface of the exhaust log and a plurality of exhaust runner cooling passages that each axially convey the cooling water along an outer surface of a respective one of the plurality of exhaust runners from the exhaust log cooling jacket to the engine cooling passage.

32 Claims, 7 Drawing Sheets

OUTBOARD MARINE PROPULSION DEVICES AND METHODS OF MAKING OUTBOARD MARINE PROPULSION DEVICES HAVING EXHAUST RUNNER COOLING PASSAGES

FIELD

The present disclosure relates to exhaust systems and methods of assembling exhaust systems for marine propulsion devices having an internal combustion engine.

BACKGROUND

The following U.S. Patents and Patent Application are incorporated herein by reference, in entirety.

U.S. Pat. No. 8,783,217 discloses a cooling system for a marine engine that is provided with various cooling channels and passages which allow the rates of flow of its internal streams of water to be preselected so that heat can be advantageously removed at varying rates for different portions of the engine. In addition, the direction of flow of cooling water through the various passages assists in the removal of heat from different portions of the engine at different rates so that overheating can be avoided in certain areas, such as the exhaust manifold and cylinder head, while overcooling is avoided in other areas, such as the engine block.

U.S. Pat. No. 8,763,566 discloses a cooling system for a marine engine that is provided with various cooling channels which allow the advantageous removal of heat at different rates from different portions of the engine. A split flow of water is conducted through the cylinder head, in opposite directions, to individually cool the exhaust port and intake ports at different rates. This increases the velocity of coolant flow in the downward direction through the cylinder head to avoid the accumulation of air bubbles and the formation of air pockets that could otherwise cause hot spots within the cylinder head. A parallel coolant path is provided so that a certain quantity of water can bypass the engine block and avoid overcooling the cylinder walls.

U.S. Pat. No. 8,696,394 discloses a marine propulsion system that comprises an internal combustion engine, a cooling circuit carrying cooling fluid that cools the internal combustion engine, a sump holding oil that drains from the internal combustion engine, and a heat exchanger receiving the cooling fluid. The oil that drains from the internal combustion engine to the sump passes through and is cooled by the heat exchanger.

U.S. Pat. No. 8,540,536 discloses a cooling system for a marine engine that has an elongated exhaust conduit comprising a first end receiving hot exhaust gas from the marine engine and a second end discharging the exhaust gas; and an elongated cooling water jacket extending adjacent to the exhaust conduit. The cooling water jacket receives raw cooling water at a location proximate to the second end of the exhaust conduit, conveys raw cooling water adjacent to the exhaust conduit to thereby cool the exhaust conduit and warm the raw cooling water, and thereafter discharges the warmed cooling water to cool the internal combustion engine.

U.S. Pat. No. 8,500,501 discloses an outboard marine drive that includes a cooling system drawing cooling water from a body of water in which the outboard marine drive is operating, and supplying the cooling water through cooling passages in an exhaust tube in the driveshaft housing, a catalyst housing, and an exhaust manifold, and thereafter through cooling passages in the cylinder head and the cylinder block of the engine. A 3-pass exhaust manifold is provided. A method is provided for preventing condensate formation in a cylinder head, catalyst housing, and exhaust manifold of an internal combustion engine of a powerhead in an outboard marine drive.

U.S. Pat. No. 8,479,691 discloses a cooling system for a marine engine that is provided with various cooling channels which allow the advantageous removal of heat at different rates from different portions of the engine. A split flow of water is conducted through the cylinder head, in opposite directions, to individually cool the exhaust port and intake ports at different rates. This increases the velocity of coolant flow in the downward direction through the cylinder head to avoid the accumulation of air bubbles and the formation of air pockets that could otherwise cause hot spots within the cylinder head. A parallel coolant path is provided so that a certain quantity of water can bypass the engine block and avoid overcooling the cylinder walls.

U.S. Pat. No. 8,402,930 discloses a cooling system for a marine engine is provided with various cooling channels and passages which allow the rates of flow of its internal streams of water to be preselected so that heat can be advantageously removed at varying rates for different portions of the engine. In addition, the direction of flow of cooling water through the various passages assists in the removal of heat from different portions of the engine at different rates so that overheating can be avoided in certain areas, such as the exhaust manifold and cylinder head, while overcooling is avoided in other areas, such as the engine block.

U.S. Pat. No. 8,038,493 discloses a catalyzed exhaust system for an outboard motor engine that locates its catalyst device in a catalyst housing above an adapter plate which supports the engine and separates it from the driveshaft housing. The exhaust gas is directed initially in an upwardly direction and then is turned downwardly to provide space for location and easy access to the catalyst device. A coolant, such as water drawn from a body of water, is reversed in direction of flow several times in order to advantageously fill certain cooling channels in an upward direction. In addition, various coolant channels are vented to remove potential pockets of air in their upper regions.

U.S. patent application Ser. No. 14/543,458 discloses an outboard marine propulsion device that comprises an internal combustion engine having a cylinder head and a cylinder block and an exhaust manifold that discharges exhaust gases from the engine towards a vertically elongated exhaust tube. The exhaust manifold has a plurality of inlet runners that receive the exhaust gases from the engine, and a vertically extending collecting passage that conveys the exhaust gases from the plurality of inlet runners upwardly to a bend that redirects the exhaust gases downwardly towards the exhaust tube. A cooling water jacket is on the exhaust manifold and conveys cooling water alongside the exhaust manifold. A catalyst housing is coupled to the exhaust manifold and a cooling water jacket is on the catalyst housing and carries cooling water alongside the catalyst housing. A catalyst is disposed in the catalyst housing.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

An outboard marine propulsion device comprises an internal combustion engine. At least one engine cooling passage conveys cooling water through the internal combustion engine. An exhaust manifold comprises a plurality of exhaust runners and an exhaust log. The plurality of exhaust runners axially conveys exhaust gases from the internal combustion engine to the exhaust log. A cooling jacket on the exhaust manifold comprises an exhaust log cooling jacket that conveys the cooling water along an outer surface of the exhaust log and a plurality of exhaust runner cooling passages that each axially convey the cooling water along an outer surface of a respective one of the plurality of exhaust runners from the exhaust log cooling jacket to the engine cooling passage. Methods of making outboard marine propulsion devices are also disclosed.

BRIEF DESCRIPTION OF THE DRAWINGS

The present disclosure is described with reference to the following Figures. The same numbers are used throughout the Figures to reference like features and like components.

DETAILED DESCRIPTION OF THE DRAWINGS

Figure 1:
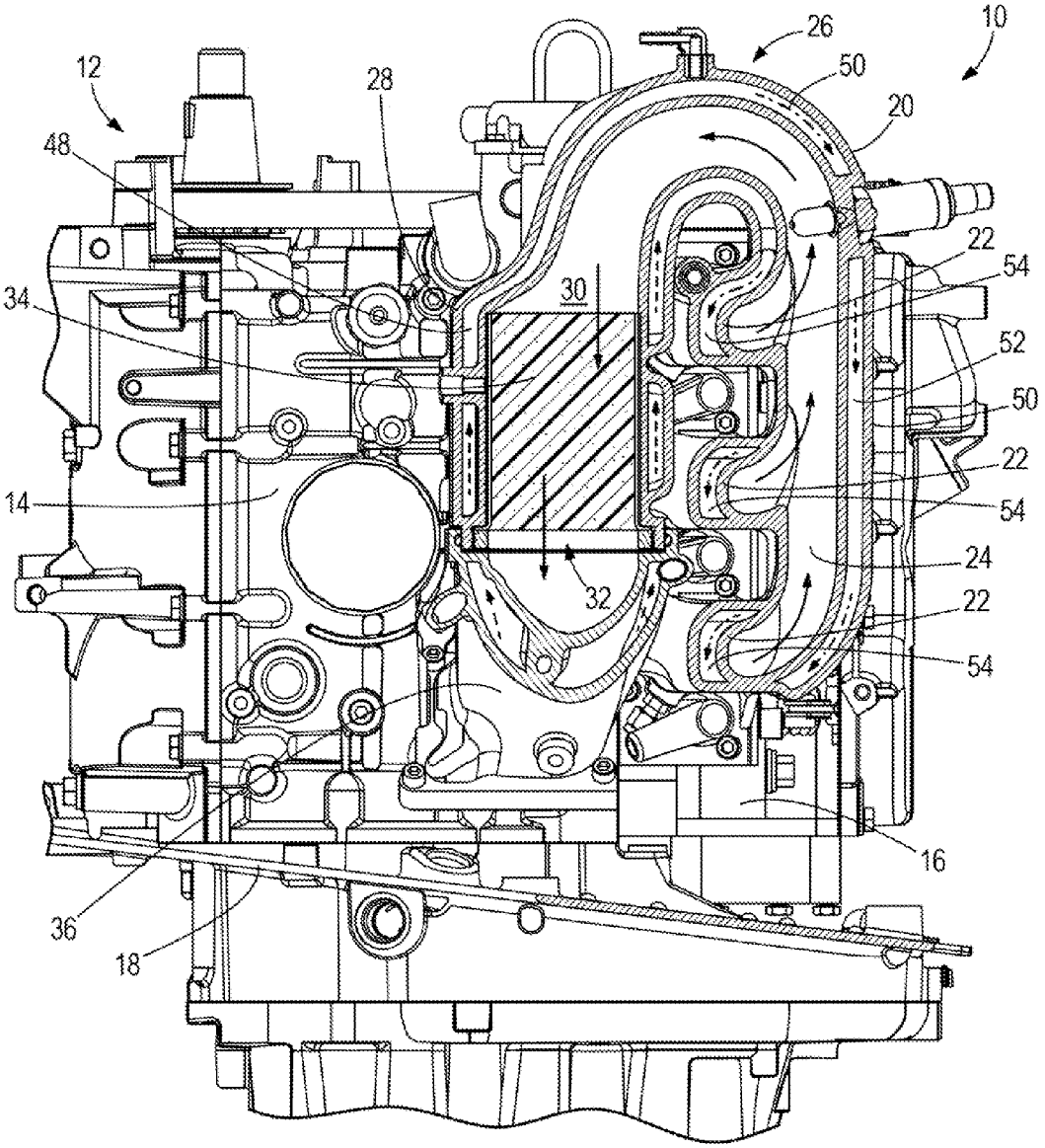
FIG. 1 is a sectional view of an internal combustion engine for an outboard marine propulsion device.

FIGS. 1-5 depict portions of an outboard marine propulsion device 10 including an internal combustion engine 12 having an engine block 14 and a cylinder head 16. The internal combustion engine 12 is supported by an adapter plate 18.

An exhaust manifold 20 is bolted onto the cylinder head 16. The exhaust manifold 20 has a plurality of exhaust runners 22 and an exhaust log 24. The exhaust runners 22 extend transversely to the exhaust log 24 and axially convey exhaust gases from the internal combustion engine 12 to the exhaust log 24, as shown by solid arrows in FIG. 1. The exhaust manifold 20 includes a top bend portion 26 that receives vertically upwardly flowing exhaust gases from the exhaust log 24 and routes the exhaust gases vertically downwardly to a catalyst housing 28. The catalyst housing 28 has a housing inlet end 30 that receives the exhaust gas flow from the top bend portion 26 and exhaust log 24. The catalyst housing 28 also has an opposite, housing outlet end 32 that discharges the exhaust gas flow, which ultimately is discharged from the outboard marine propulsion device 10. A catalyst 34 is disposed in the catalyst housing 28 and is configured to treat exhaust gases flowing therethrough in a conventional manner. As shown in FIG. 1, an outlet collector 36 is disposed on the catalyst housing 28 at the housing outlet end 32. The outlet collector 36 receives the exhaust gas flow from the housing outlet end 32. The outlet collector 36 conveys the noted exhaust gas flow to the internal combustion engine 12 (in the illustrated example, to the engine block 14) and then the adapter plate 18 for discharge from the outboard marine propulsion device 10.

Figure 6:
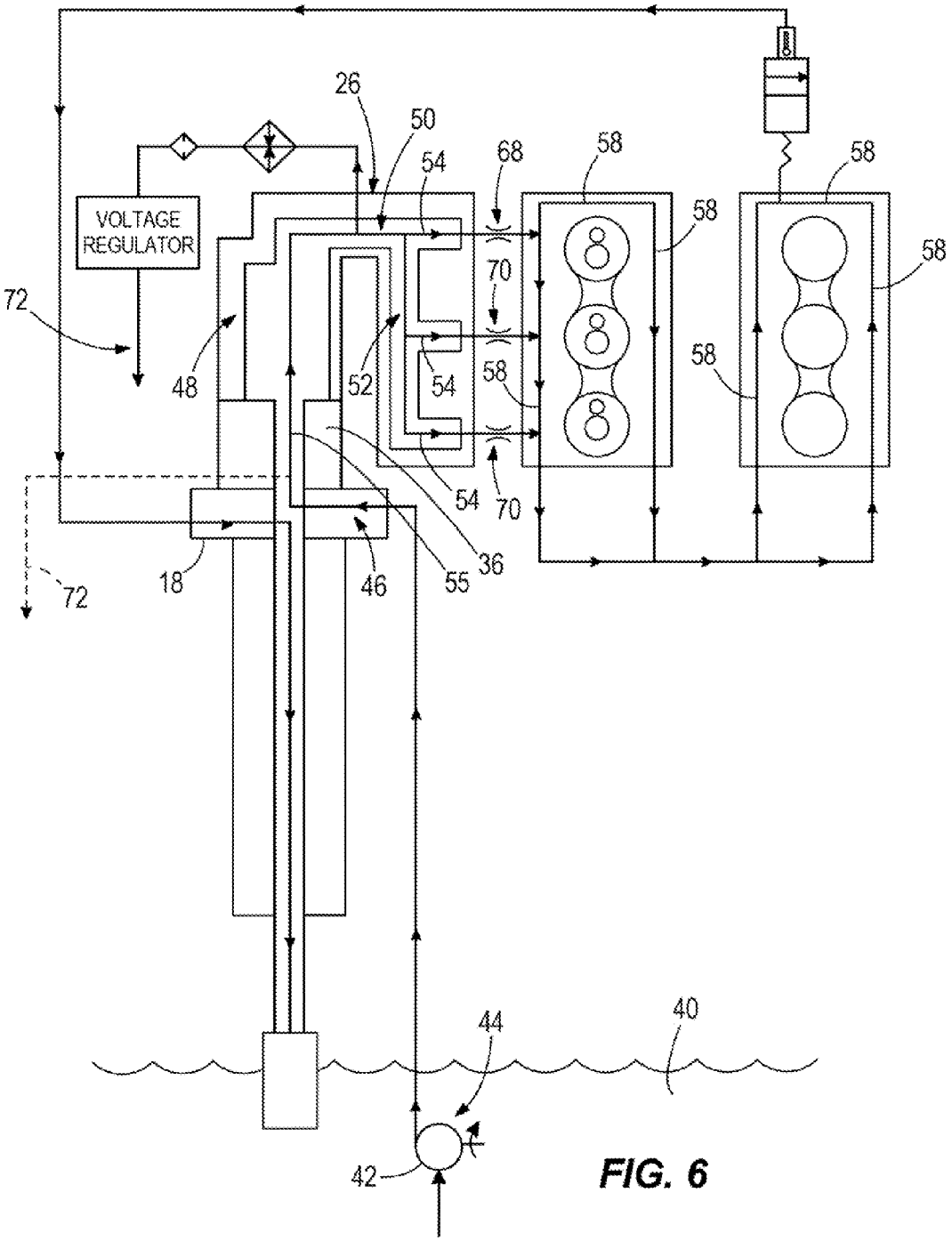
FIG. 6 is a schematic view of a first exemplary cooling circuit for the outboard marine propulsion device.

FIGS. 1 and 6 depict one example of an open cooling water circuit for the outboard marine propulsion device 10. The cooling water circuit provides cooling water from the body of water 40 in which the outboard marine propulsion device 10 is operating, along or through various components of the outboard marine propulsion device 10, and back to the body of water 40. Flow of cooling water is shown in dashed lines in FIG. 1 and in solid lines in FIG. 6. The open cooling circuit includes several cooling jackets that convey the cooling water along outer surfaces of the components of the outboard marine propulsion device 10 such that the cooling water exchanges heat with the components. The exact configuration of the open cooling circuit can vary from that which is shown in the figures. In the illustrated example, a cooling water pump 42 pumps the cooling water from upstream to downstream through the cooling water circuit, including the noted cooling jackets. More specifically, the cooling water pump 42 pumps the cooling water from an inlet 44 on the outboard marine propulsion device 10 through a cooling water passage 46 in the adapter plate 18 and through a cooling water jacket 48 on outer surfaces of the catalyst housing 28. From the cooling water jacket 48, the cooling water flows through a cooling water jacket 50 on the top bend portion 26 and an exhaust log cooling water jacket 52 on the exhaust log 24 of the exhaust manifold 20. The cooling water jackets 50 and 52 thus convey cooling water on outer surfaces of the top bend portion 26 and exhaust log 24, respectively, so that heat is exchanged between the top bend portion 26 and exhaust log 24 and the cooling water.

The cooling water flows from the exhaust log cooling water jacket 52 into a plurality of exhaust runner cooling passages 54 that each axially convey the cooling water along an outer surface 56 (see FIGS. 3 and 4) of a respective one of the plurality of exhaust runners 22 from the exhaust log cooling water jacket 52 to a plurality of engine cooling passages 58 (see FIG. 6) that convey cooling water through the internal combustion engine 12. Thus, as shown in FIG. 6, the cooling water pump 42 pumps the cooling water from upstream to downstream through the cooling water passage 46 in the adapter plate 18, a cooling water jacket 48 on outer surfaces of the catalyst housing 28, a cooling water jacket 50 on the top bend portion 26, an exhaust log cooling water jacket 52, through the plurality of horizontally extending exhaust runner cooling passages 54, and then to the internal combustion engine 12.

Figure 3:
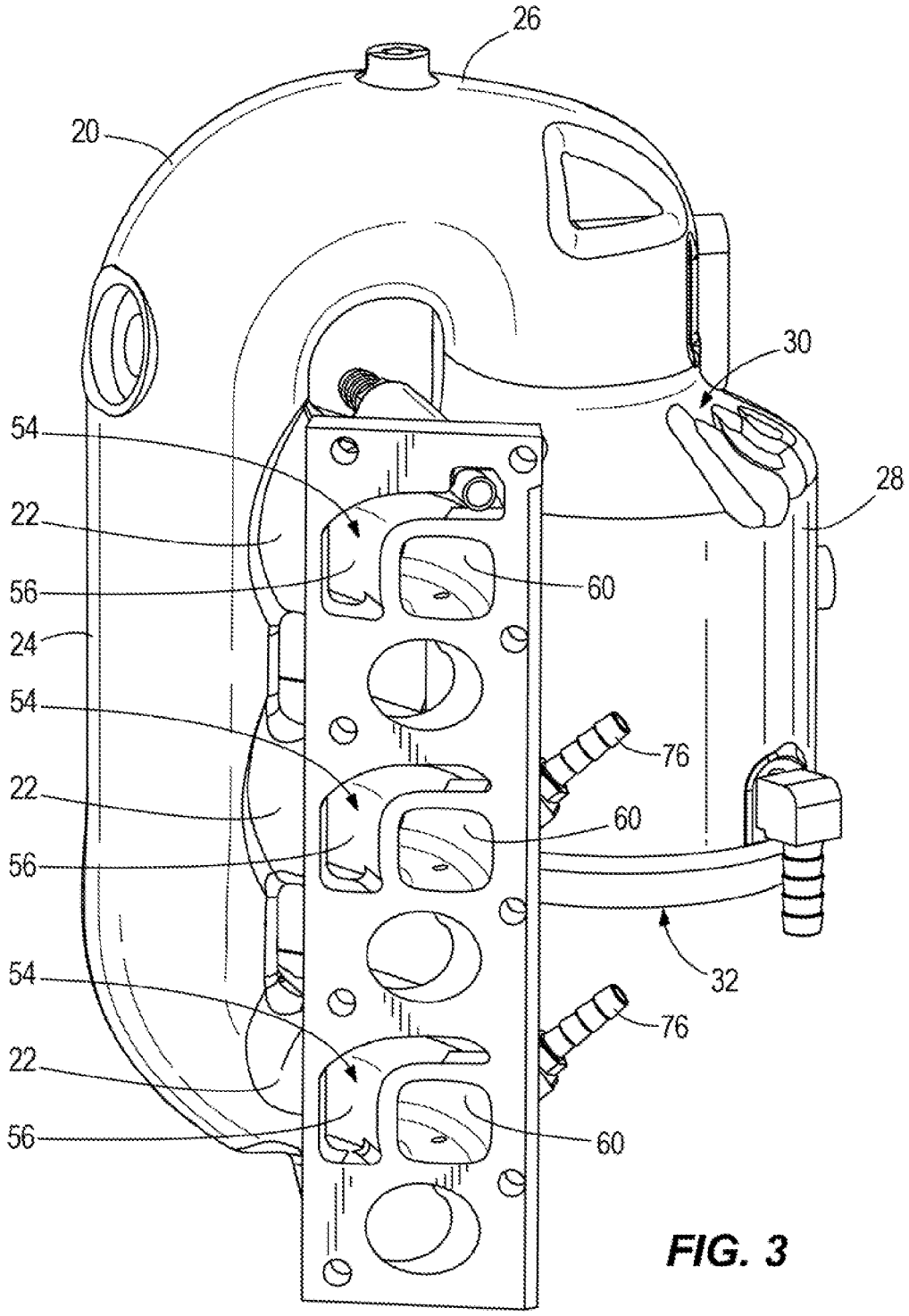
FIG. 3 is a front view of the exhaust manifold.
Figure 4:
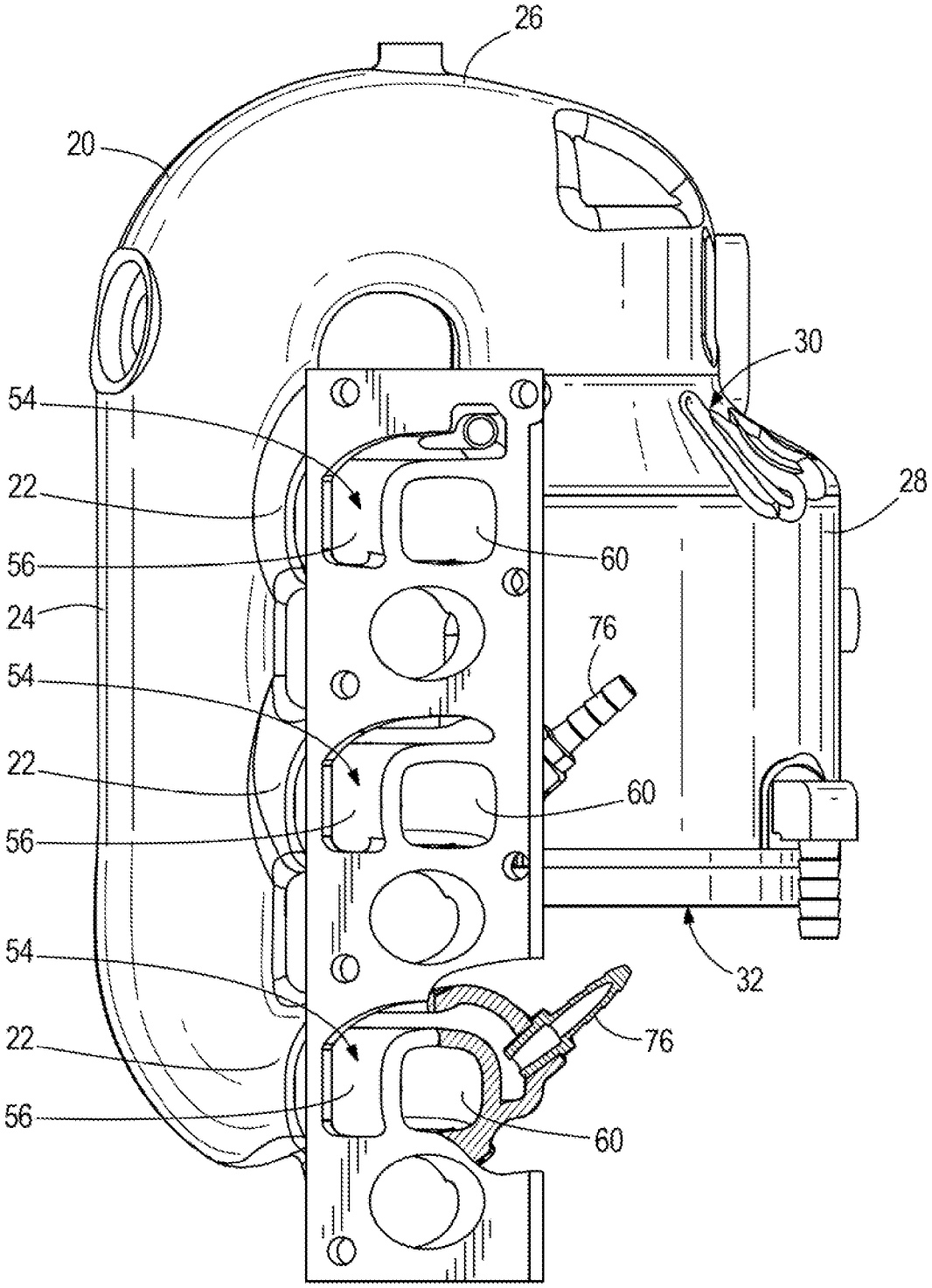
FIG. 4 is a front view of the exhaust manifold, partially cut away.

Referring now to FIGS. 3 and 4, each exhaust runner 22 includes a radially inner peripheral surface 60 and the noted outer surface 56, which is defined by the outer extent of an associated exhaust runner cooling passage 54. As can be seen in FIG. 4, the outer surface 56 is adjacent a top and side portions of the radially inner peripheral surface 60. The bottom or lower portion of the radially inner peripheral surface 60 is thus devoid of a cooling jacket. As best shown in FIG. 4, each exhaust runner cooling passage 54 has an inverted U-shape.

Figure 2:
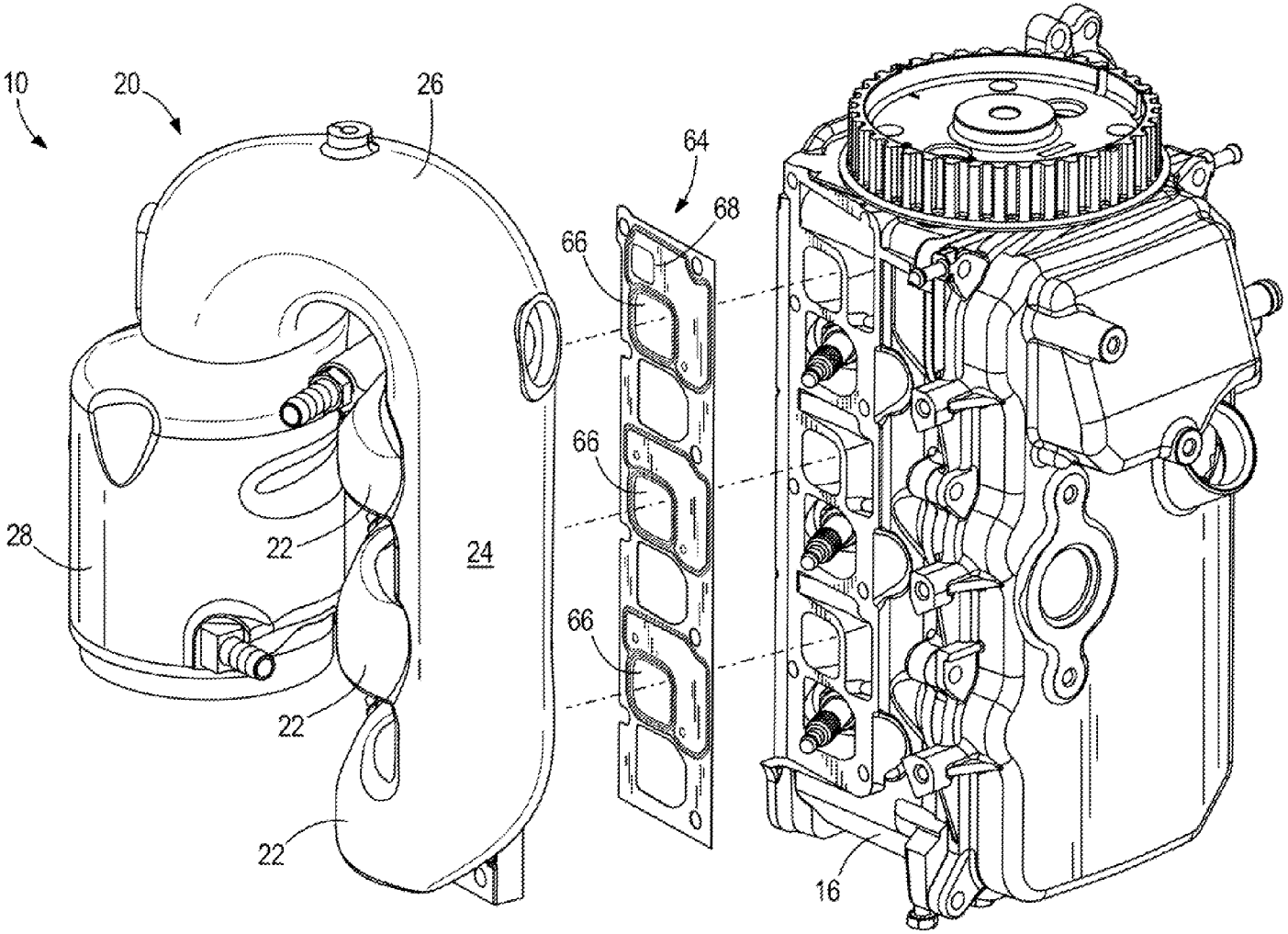
FIG. 2 is an exploded view of cylinder head of the internal combustion engine, an exhaust manifold, and a gasket disposed between the cylinder head and the exhaust manifold.
Figure 5:
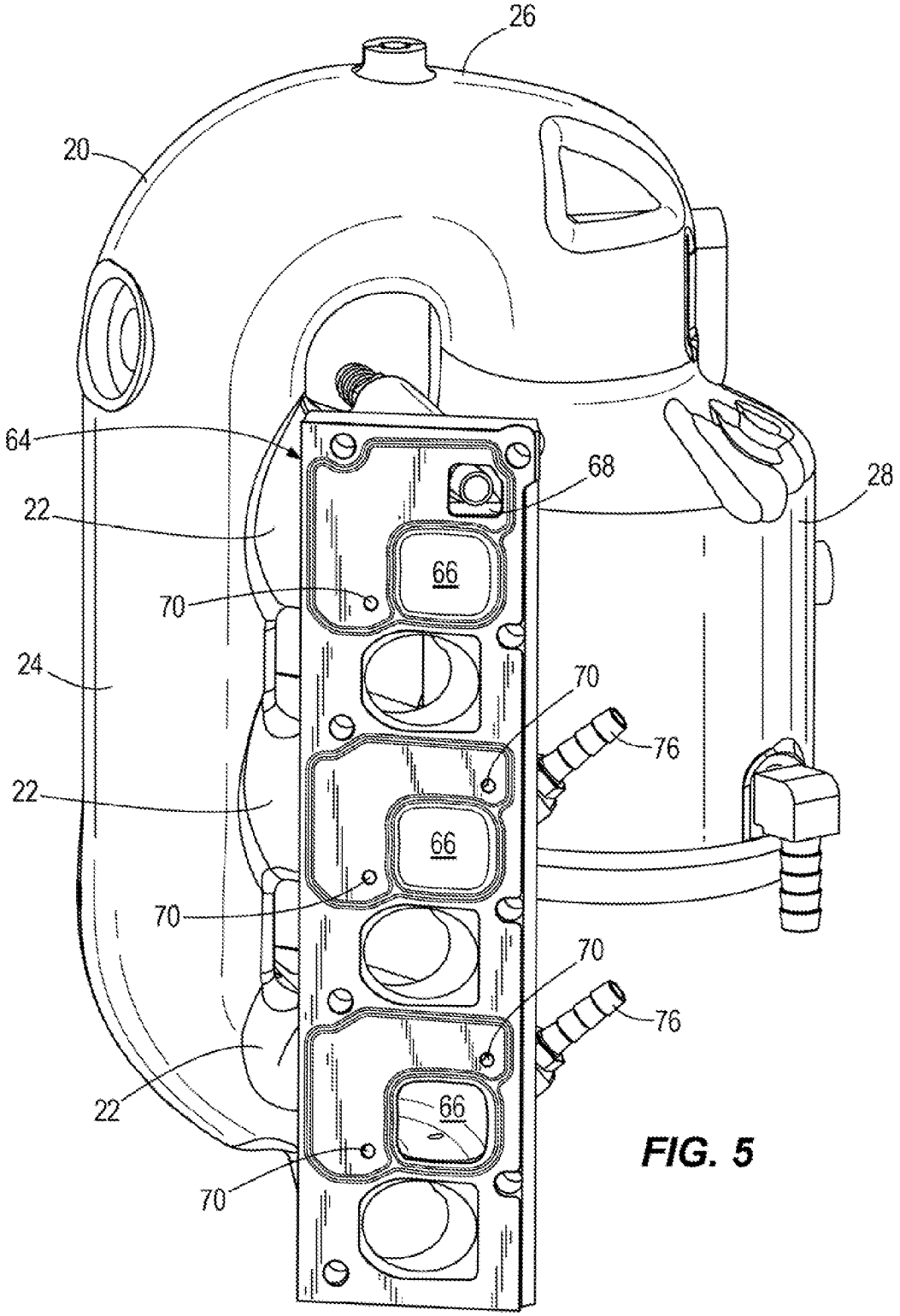
FIG. 5 is a front view of the gasket on the exhaust manifold.

Referring to FIGS. 2 and 5, a gasket 64 is disposed between the cylinder head 16 and the exhaust log cooling water jacket 52. The gasket 64 has a plurality of exhaust holes 66 through which the exhaust gases are conveyed from the internal combustion engine 12 to the plurality of exhaust runners 22. The gasket 64 further includes a plurality of cooling water holes through which cooling water is conveyed from the plurality of exhaust runner cooling passages 54 to the internal combustion engine 12. Each of the noted cooling water holes in the plurality can have a different cross-sectional area than the cross-sectional area of the plurality of exhaust runner cooling passages 54. In the illustrated example, a larger first cooling water hole 68 is located adjacent the uppermost, first exhaust runner 22. Relatively smaller second cooling water holes 70 are located adjacent the first exhaust runner 22 and lower, second exhaust runners 54. The first cooling water hole 68 has a larger cross-sectional area than the second cooling water holes 70. Because of the difference in cross-sectional area of the cooling water holes 68, 70, more cooling water flows alongside the uppermost exhaust runner 22 than the remaining, lower exhaust runners. That is, in the vertically-aligned plurality of exhaust runners 22, the larger cross-sectional area of the first cooling water hole 68 causes more of the cooling water to be conveyed along the outer surface 56 of the vertically highest exhaust runner 22 than the outer surface 56 of the remaining, vertically lower exhaust runners.

In certain examples, the cross-sectional area of the exhaust runner cooling passages 54 can be different than each other. For example, the highest exhaust runner cooling passage can have a larger cross-sectional area than the relatively lower exhaust runner cooling passages so that more of the cooling water is conveyed along the outer surface of the highest exhaust runner than the outer surfaces of the lower exhaust runners.

Referring now to FIG. 6, a telltale 72 is connected to the cooling jacket 50 at the top bend portion 26. In other examples, the telltale 72 can be connected to the cooling jacket on the outlet collector 36 (as shown in dashed line).

Through research and experimentation, the present inventors have determined that by flowing the cooling water axially along the outer surfaces of the exhaust runners, rather than perpendicularly to the exhaust runners, the amount of the outer surface of the exhaust runner having a water jacket can be tailored to achieve specific amounts of heat exchange at the exhaust runners. This geometry provides additional design flexibility and permits tailoring of the shape of the water jacket. In the illustrated example, the bottom inner surfaces of the exhaust runners are without a water jacket. The present inventors have found that this advantageously causes an increase in the temperature of the lower inner surface of the runners, which causes evaporation of any condensation that might accumulate in the exhaust passage in this area. This design also provides tool access for spark plugs. In certain examples the resulting cooling water passages can have the inverted U-shape shown in FIG. 4.

Through research and experimentation, the inventors have found that disposing a gasket 64 between the exhaust manifold 20 and the cylinder head 16 allows the designer to control/tailor the amount of cooling water flow around each exhaust runner. In the illustrated example, the majority of cooling water flows through the square-shaped hole 68 above the highest exhaust runner 22. Smaller cooling water holes 70 are provided at the bottom edges of the cooling passages on all three exhaust runners 22 and at the top edges of the lower exhaust runners 22. This arrangement can be varied from that which is shown. Advantageously, the size and placement of the holes in the gasket 64 can be varied to tailor/control the amount of cooling water flowing past each exhaust runner 22 and the location at which the cooling water flows. In the illustrated example, by routing the majority of the cooling water to the cylinder head 16 upstream of the exhaust runners 22, the lower exhaust runners 22 were allowed to function with warmer metal temperatures. This was found to minimize condensation issues inside the exhaust passages. The holes can favorably be placed in areas that are likely to be stagnant areas, leading to boiling if the holes had not been there.

During research and development, the present inventors found that incorporating the telltale 72 at the top of the 180 degree bend portion 26 provides several advantages. For example, the cooling jacket 50 on the bend portion 26 is the highest point in the cooling circuit. Adding the telltale 72 at the highest point allows the telltale 72 to vent air from the cooling circuit and also allows the cooling circuit to be completely filled with cooling water. Optionally, the water in the telltale 72 can be routed to other cooling jackets, such as through a fuel cooler cooling jacket or a voltage regulator cooling jacket, and/or discharge directly overboard. Also, by pulling the cooling water out of the telltale 72 prior to the exhaust log 24, the amount of cooling water flowing over the exhaust runners 22 was reduced, which minimized over-cooling at low engine speeds/low engine loads.

In other examples, the cooling circuit shown in FIG. 6 can have the telltale 72 (shown in dashed line) located at the cooling jacket 55 on the lower exhaust collector 36. This can minimize the amount of cooling water flowing past the catalyst 34 to thereby avoid over cooling and potential condensation formation. In this example, the cooling circuit can include a vent at the top of the exhaust manifold 20 at the bend 26 to purge air from the cooling circuit.

Figure 7:
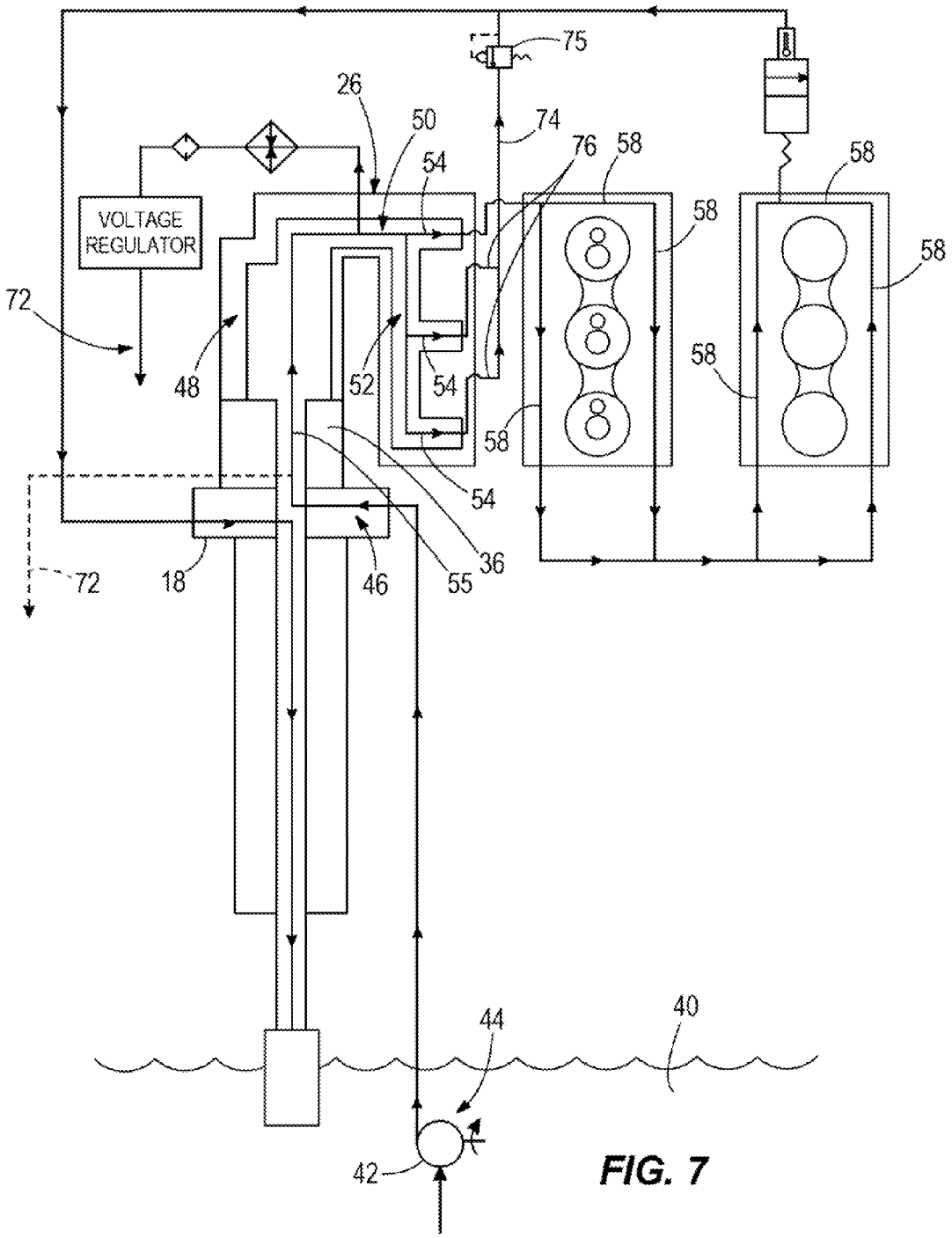
FIG. 7 is a schematic view of a second exemplary cooling circuit for the outboard marine propulsion device.

Referring to FIG. 7, a cooling water relief conduit 74 conveys cooling water from the plurality of exhaust runner cooling passages 54 from a location between the exhaust log cooling jacket 52 and the engine cooling passages 58. A pressure control valve or an orifice 75 can be provided that restricts flow of cooling water through the cooling water relief conduit 74 at lower engine speeds and allows flow of cooling water through the cooling water relief conduit 74 at relatively higher engine speeds. In some examples, the present inventors have provided external fittings 76 (see also FIGS. 3-5) on the cooling jackets 54 that allow cooling water to be routed externally from the cooling circuit. For example, extra cooling water can be flowed through the cooling passages 54 and then routed to other locations such as a telltale or auxiliary devices such as the noted fuel cooler and/or the like. A poppet, a pressure control valve, or an orifice optionally can be connected to these fittings in order to limit or restrict the flow at low engine speed and to permit flow at higher speeds. Optionally, the external fittings could be connected together to allow use of a single poppet or pressure control valve. This is reflected in FIG. 7 at 74 and 75. One advantage of utilizing a poppet or valve is that the poppet or valve can be configured so that cooling water flow to the exhaust runners 22 is shut off at low speeds/light engine loads to minimize or avoid condensation. The valve/poppet can be configured to open at the proper time to sufficiently cool the exhaust runners 22 at higher engine speeds/engine loads.

The present disclosure thus provides methods of making outboard marine engines that include providing an internal combustion engine 12 having an engine cooling passage 58 that conveys cooling water through the internal combustion engine 12. An exhaust manifold 20 is mounted (e.g. bolted) onto the internal combustion engine 12 and includes a plurality of exhaust runners 22 and an exhaust log 24. The exhaust runners 22 axially convey exhaust gases from the internal combustion engine 12 to the exhaust log 24. Cooling jackets 50, 52, 54 are provided on the exhaust manifold 20 and includes an exhaust log cooling jacket 52 that conveys cooling water along an outer surface of the exhaust log 24 and a plurality of exhaust runner cooling passages 54 that each axially convey the cooling water along an outer surface 56 of the respective one of the exhaust runners 22 between the exhaust log 24 and the engine cooling passages 58.

The methods can further include providing a gasket 64 between the cylinder head 16 and the cooling jackets 50, 52, 54. The gasket 64 can include a plurality of exhaust holes 66 through which exhaust gases are conveyed and further include a plurality of cooling water holes 68, 70 through which cooling water is conveyed. The cooling water holes 68, 70 can selectively be formed with different cross-sectional areas and locations so as to tailor the amount of cooling water and location of cooling water flow past the exhaust runners 22.

A telltale 72 can be incorporated into the cooling circuit and the location(s) of the telltale can be selected to provide the functional advantages described herein above.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

What is claimed is:

1. An outboard marine propulsion device comprising:

an internal combustion engine;

at least one engine cooling passage that conveys cooling water through the internal combustion engine;

an exhaust manifold that comprises a plurality of exhaust runners and an exhaust log, wherein the plurality of exhaust runners axially conveys exhaust gases from the internal combustion engine to the exhaust log; and a cooling jacket on the exhaust manifold, wherein the cooling jacket comprises an exhaust log cooling jacket that conveys the cooling water along an outer surface of the exhaust log and a plurality of exhaust runner cooling passages that each axially convey the cooling water along an outer surface of a respective one of the plurality of exhaust runners from the exhaust log cooling jacket to the at least one engine cooling passage.

2. The outboard marine engine according to claim 1, wherein each exhaust runner in the plurality of exhaust runners comprises radially inner surface and wherein the outer surface of each exhaust runner cooling passage is adjacent only a portion of the radially inner surface.

3. The outboard marine engine according to claim 2, wherein the portion of the radially inner surface is a top portion and wherein a lower portion of the radially inner surface is devoid of a cooling jacket.

4. The outboard marine engine according to claim 2, wherein when viewed in cross-section each exhaust runner cooling passage has an inverted U-shape.

5. The outboard marine engine according to claim 1, further comprising a gasket disposed between the internal combustion engine and the cooling jacket on the exhaust manifold, wherein the gasket comprises a plurality of exhaust holes through which exhaust gases are conveyed from the internal combustion engine to the plurality of exhaust runners.

6. The outboard marine engine according to claim 5, wherein the gasket further comprises a plurality of cooling water holes through which the cooling water is conveyed between the plurality of exhaust runner cooling passages and the at least one engine cooling passage in the internal combustion engine.

7. The outboard marine engine according to claim 6, wherein the cooling water holes in the plurality of cooling water holes each have a different cross-sectional area than the plurality of exhaust runner cooling passages.

8. The outboard marine engine according to claim 6, wherein the plurality of cooling water holes includes at least a first cooling water hole located adjacent a first exhaust runner in the plurality of exhaust runners and a second cooling water hole located adjacent a downstream, second exhaust runner in the plurality of exhaust runners, wherein the first cooling water hole has a larger cross-sectional area than the second cooling water hole.

9. The outboard marine engine according to claim 8, wherein the plurality of exhaust runners are vertically aligned and wherein the plurality of exhaust runner cooling passages are vertically aligned and wherein the larger cross-sectional area of the first cooling water hole causes more of the cooling water to be conveyed along an outer surface of the first exhaust runner than an outer surface of the second exhaust runner; wherein the second exhaust runner is vertically lower than the first exhaust runner.

10. The outboard marine engine according to claim 1, wherein a vertically higher first exhaust runner cooling passage in the plurality of exhaust runner cooling passages has a larger cross-sectional area than a vertically lower second exhaust runner cooling passage in the plurality of exhaust runner cooling passages so that more of the cooling water is conveyed along an outer surface of the first exhaust runner than an outer surface of the second exhaust runner.

11. The outboard marine engine according to claim 1, wherein the internal combustion engine comprises an engine block and a cylinder head and wherein the at least one cooling passage is formed at least in the cylinder head.

12. The outboard marine engine according to claim 1, further comprising a cooling water pump that pumps cooling water from upstream to downstream through the exhaust log cooling water jacket, through the plurality of horizontally extending exhaust runner cooling passages, and then into the internal combustion engine.

13. The outboard marine engine according to claim 1, further comprising at least one cooling water relief conduit that conveys cooling water from the plurality of exhaust runner cooling passages at a location between the exhaust log cooling jacket and the at least one engine cooling passage.

14. The outboard marine engine according to claim 13, further comprising a pressure control valve or an orifice that restricts flow of cooling water through the at least one cooling water relief conduit at lower engine speeds and allows flow of cooling water through the at least one cooling water relief conduit at higher engine speeds.

15. The outboard marine engine according to claim 1, wherein the exhaust manifold comprises a top bend portion that receives exhaust gases from the exhaust log and further comprising a telltale connected to the cooling jacket at the top bend portion.

16. The outboard marine engine according to claim 1, further comprising catalyst housing having a housing inlet end that receives an exhaust gas flow from the exhaust log and an opposite, housing outlet end that discharges the exhaust gas flow; a catalyst disposed in the catalyst housing; an outlet collector that receives the exhaust gas flow from the housing outlet end, wherein the outlet collector comprises a collector inlet end that is engaged with the housing outlet end.

17. The outboard marine engine according to claim 16, further comprising a telltale connected to the cooling jacket at the outlet collector.

18. A method of making an outboard marine engine, the method comprising:

providing an internal combustion engine having at least one engine cooling passage that conveys cooling water through the internal combustion engine;

providing an exhaust manifold that having a plurality of exhaust runners and an exhaust log, wherein the plurality of exhaust runners axially conveys exhaust gases from the internal combustion engine to the exhaust log; and providing a cooling jacket on the exhaust manifold, the cooling jacket comprising an exhaust log cooling jacket that conveys the cooling water along an outer surface of the exhaust log and a plurality of exhaust runner cooling passages that each axially convey the cooling water along an outer surface of a respective one of the plurality of exhaust runners from the exhaust log cooling jacket to the at least one engine cooling passage.

19. The method according to claim 18, wherein each exhaust runner in the plurality of exhaust runners comprises radially inner surface and further comprising forming the plurality of exhaust runner cooling passages such that the outer surface of the respective one of the plurality of exhaust runners is adjacent only a portion of the radially inner surface of a respective one of the plurality of exhaust runners.

20. The method according to claim 19, wherein the portion of the radially inner surface is a top portion and wherein a lower portion of the radially inner surface is devoid of a cooling jacket.

21. The method according to claim 18, further comprising providing a gasket disposed between the internal combustion engine and the cooling jacket to thereby control flow of cooling water through each respective exhaust runner cooling passage.

22. The method according to claim 21, further comprising forming a plurality of exhaust holes in the gasket through which exhaust gases are conveyed between the internal combustion engine and the plurality of exhaust runners, and forming a plurality of cooling water holes in the gasket through which cooling water is conveyed between the plurality of exhaust runner cooling passages and the internal combustion engine.

23. The method according to claim 22, further comprising selecting a size of each cooling water hole in the plurality of cooling water holes to thereby control the flow of cooling water through each respective exhaust runner cooling passage.

24. The method according to claim 23, further comprising forming the cooling water holes in each of the plurality of cooling water holes with a different cross-sectional area than a corresponding exhaust runner cooling passage in the plurality of exhaust runner cooling passages.

25. The method according to claim 24, wherein the plurality of cooling water holes includes at least a first cooling water hole located adjacent a first exhaust runner in the plurality of exhaust runners and a second cooling water hole located adjacent a downstream, second exhaust runner in the plurality of exhaust runners, wherein the first cooling water hole has a larger cross-sectional area than the second cooling water hole.

26. The method according to claim 18, wherein the plurality of exhaust runners are vertically aligned and wherein the plurality of exhaust runner cooling passages are vertically aligned and further comprising forming the plurality of exhaust runner cooling passages so that more of the cooling water is conveyed along an outer surface of the first exhaust runner than an outer surface of the second exhaust runner; wherein the second exhaust runner is vertically lower than the first exhaust runner.

27. The method according to claim 18, further comprising pumping cooling water from upstream to downstream through the exhaust log cooling jacket, through the plurality of horizontally extending exhaust runner cooling passages and then to the internal combustion engine.

28. The method according to claim 18, further comprising providing at least one cooling water conduit that conveys cooling water from the plurality of exhaust runner cooling passages from a location between the exhaust log cooling jacket and the at least one engine cooling passage.

29. The method according to claim 28, further comprising restricting flow of cooling water through the at least one cooling water conduit at lower engine speeds and permitting increased flow of cooling water through the at least one cooling water conduit at higher engine speeds.

30. The method according to claim 18, further comprising providing a telltale at a top bend portion of the exhaust manifold that receives exhaust gases from the exhaust log.

31. The method according to claim 18, further comprising providing a catalyst housing having a housing inlet end that receives an exhaust gas flow from the exhaust log and an opposite, housing outlet end that discharges the exhaust flow; disposing a catalyst in the catalyst housing; providing an outlet collector that receives the exhaust flow from the housing outlet end, wherein the outlet collector comprises a collector inlet end that is engaged with the housing outlet end.

32. The method according to claim 31, further comprising providing a telltale connected to the cooling jacket at the outlet collector.

* * * * *